US008333575B2

(12) United States Patent
Grann et al.

(10) Patent No.: US 8,333,575 B2
(45) Date of Patent: Dec. 18, 2012

(54) PUMP ASSEMBLY

(75) Inventors: Helge Grann, Bjerringbro (DK); Christian Rasmussen, Tjele (DK)

(73) Assignee: Grundfos Management a/s, Bjerringbro (DK)

( * ) Notice: Subject to any disclaimer, the term of this patent is extended or adjusted under 35 U.S.C. 154(b) by 888 days.

(21) Appl. No.: 12/067,868

(22) PCT Filed: Sep. 20, 2006

(86) PCT No.: PCT/EP2006/009113

§ 371 (c)(1),
(2), (4) Date: Sep. 4, 2008

(87) PCT Pub. No.: WO2007/033817

PCT Pub. Date: Mar. 29, 2007

(65) Prior Publication Data

US 2009/0035161 A1 Feb. 5, 2009

(30) Foreign Application Priority Data

Sep. 24, 2005 (EP) ..... 05020868

(51) Int. Cl.
*F04B 35/04* (2006.01)

(52) U.S. Cl. ..... 417/423.3; 417/423.7; 417/365

(58) Field of Classification Search ..... 417/423.3, 417/423.7, 423.12, 365
See application file for complete search history.

(56) References Cited

U.S. PATENT DOCUMENTS

| | | | | |
|---|---|---|---|---|
| 3,265,001 | A * | 8/1966 | Deters | 415/68 |
| 3,395,644 | A * | 8/1968 | Grant et al. | 417/357 |
| 3,824,035 | A | 7/1974 | Laing | |
| 6,234,772 | B1 * | 5/2001 | Wampler et al. | 417/423.12 |
| 6,293,772 | B1 | 9/2001 | Brown et al. | |
| 6,367,247 | B1 * | 4/2002 | Yancey | 60/412 |
| 7,431,688 | B2 * | 10/2008 | Wampler et al. | 600/16 |
| 2002/0192088 | A1 | 12/2002 | Racer et al. | |
| 2004/0052645 | A1 * | 3/2004 | Christensen | 417/53 |
| 2004/0219021 | A1 | 11/2004 | Shaw | |

FOREIGN PATENT DOCUMENTS

| | | | |
|---|---|---|---|
| CN | 1481478 | A | 3/2004 |
| DE | 33 37 086 | A1 | 5/1985 |
| DE | 88 16 412.8 | U1 | 9/1989 |
| DE | 41 29 590 | A1 | 3/1993 |
| DE | 94 02 593.2 | U1 | 5/1994 |
| DE | 44 40 967 | A1 | 5/1996 |
| DE | 296 08 236 | U1 | 8/1996 |
| EP | 0 240 674 | A2 | 10/1987 |
| EP | 1 231 048 | A2 | 8/2002 |
| GB | 2 071 765 | A | 9/1981 |
| WO | 99/25055 | A1 | 5/1999 |
| WO | 02/052156 | A1 | 7/2002 |
| WO | 02/052365 | A3 | 6/2005 |
| WO | 2005/052365 | A2 | 6/2005 |

* cited by examiner

*Primary Examiner* — Anh Mai
*Assistant Examiner* — Kevin Quarterman
(74) *Attorney, Agent, or Firm* — Panitch Schwarze Belisario & Nadel LLP

(57) ABSTRACT

A pump unit is provided having a wet-running electric motor, wherein a rotor of the pump unit can be driven by the electric motor at a maximum speed of greater than 20,000 rev/min, and the rotor is sealed off axially in the region of a suction port.

24 Claims, 4 Drawing Sheets

PUMP ASSEMBLY

CROSS-REFERENCE TO RELATED APPLICATIONS

This application is a Section 371 of International Application No. PCT/EP2006/009113, filed Sep. 20, 2006, which was published on Mar. 29, 2007, under International Publication No. WO 2007/033817 A1 and the disclosure of which is incorporated herein by reference.

BACKGROUND OF THE INVENTION

The invention relates to a pump assembly with a wet-running electric motor.

Pump assemblies with wet-running electric motors are, for example, applied as submersible pump assemblies or heating circulation pump assemblies. Particularly with submersible pump assemblies, a high delivery capacity with a compact construction and low energy consumption are desirable. In order to achieve greater delivery capacities, usually several stages are provided in submersible pump assembles. This, on the one hand, leads to a more complicated construction of the pump assembly, whereby the assembly requires more effort. On the other hand, the total friction of the pump assembly is also increased, whereby the power loss is increased.

BRIEF SUMMARY OF THE INVENTION

It is therefore an object of the invention to provide an improved pump assembly with a higher efficiency.

The pump assembly according to the invention, which comprises a wet-running electric motor, is provided with an impeller which may be driven by the wet-running electric motor with a maximal speed of greater than 20,000 rev./min. (rpm), preferably greater than 25,000 rpm, and more preferably greater than 30,000 rpm. A high delivery capacity of the pump may also be achieved with only one impeller with a comparatively small diameter due to this high speed. The friction and thus losses of the pump assembly may be minimized by a small diameter of the impeller. Furthermore, according to the invention, the impeller is simultaneously axially sealed in the region of the suction port. The axial sealing of the suction port has the advantage that the axial surface of the impeller, preferably the surface distant from the electric motor, may simultaneously serve as a sealing surface, so that the number of necessary sealing elements is reduced, and a simple and reliable sealing may be formed in the region of the suction port. This leads to a further reduction of the friction and of losses in the pump assembly, and thus to a higher efficiency.

Particularly preferably, at least one axial end of the impeller furthermore forms an axial bearing surface. In this manner, the number of required components for mounting the rotor is reduced, since the impeller may itself be a part of the axial bearing. This on the one hand permits a simplified and compact construction of the whole pump assembly, and on the other hand permits the power loss to be further minimized and thus the efficiency to be increased. The bearing surface, particularly preferably, simultaneously serves as an axial sealing surface. This has the further advantage that no additional pressing elements are required, in order to hold the seal in bearing. An adequately small gap automatically arises in the axial bearing, which forms a sliding bearing, and this gap ensures a reliable sealing and simultaneously guarantees an adequate lubrication film on the bearing surface. The gap preferably lies in the range of a few micrometers. This ensures a particularly good sealing on the suction port, which further contributes to the increase of the efficiency of the pump assembly.

Further preferably, the impeller at an axial end side, on which the impeller blades are arranged, is formed in an open manner, and the axial end sides of the impeller blades form an axial bearing surface of the impeller. This means that the axial free end sides of the impeller blades serve for the axial mounting of the impeller and thus of the rotor shaft, and simultaneously the sealing of the impeller at its open end side. In this manner, one achieves a particularly good sealing in a very simple manner, since the impeller blades are pressed by the occurring axial force which is to be accommodated by the axial bearing, against an opposite axial bearing surface, for example of a counter-rotation disk. A very small gap between the axial end sides of the blades and the counter-rotation disk is created by this, which preferably simultaneously ensures a good sealing and an adequate lubrication film in the axial sliding bearing.

Usefully, the impeller is fixed on the rotor shaft in the axial direction, so that the impeller may assume the axial bearing function of the complete rotor. This means that the axial mounting of the whole rotor is effected at the impeller, preferably in a sliding bearing, whose axial bearing surface is formed by the axial end side of the impeller, preferably by the axial end sides of the impeller blades.

According to a further preferred embodiment, the axial side of the impeller facing the electric motor, is designed as a sealing surface for sealing the rotor space of the electric motor. This means that here, preferably also an axial sealing surface is made available, on which a stationary sealing element, for example a sealing ring bears. This sealing ring may be pressed against the sealing surface by spring biasing or flexible inherent tension. The sealing of the rotor space is preferred, in order to prevent contamination from the fluid to be delivered by the pump assembly, which is preferably water, from penetrating into the rotor space, and which there may lead to undesirable friction or even damage of the rotor. The rotor space may be pre-filled with fluid at the factory. It is alternatively possible for the fluid to penetrate into the rotor space with the first starting operation of the pump assembly. This may be ensured by the seal not being designed in a completely fluid-tight manner between the impeller and the rotor space, but merely being designed such that no contamination or only small quantities of fluid may enter into the rotor space. Thus, the fluid exchange between the pump space, in which the impeller rotates, and the rotor space in the inside of the can, is minimized or prevented. One may ensure a very simple sealing with a minimized number of components due to the fact that the sealing surface is made available directly on the impeller. Furthermore, due to the adequate sealing, one may ensure that frictional losses due to contamination do not occur, whereby a higher efficiency of the pump assembly may be ensured in a permanent manner.

The impeller, particularly preferably, comprises at least one surface of carbide or ceramic, and is preferably manufactured completely of carbide or ceramic. This design permits the minimization or prevention of wear of the impeller blades on account of contamination in the fluid, for example sand particles. Furthermore, the particularly hard or wear-resistant design of the impeller surfaces permits the application as sliding bearing surfaces or axial bearing surfaces, so that one may do away with additional bearing shells or bearing elements. The wear-resistant design of the impeller furthermore permits the rotational speed of the impeller to be increased further, without a large wear occurring. This permits the increase of efficiency of the pump assembly without further stages having to be provided. Simultaneously, the impeller may be designed in a very small manner. A small impeller diameter leads to the reduction of frictional losses, whereby the efficiency of the pump assembly may be increased further. Alternatively to the design of carbide or ceramic, or to the surface coating with carbide and ceramic, one may also use other methods or coatings for hardening the surface of the impeller, provided that an adequate wear-resistance of the surfaces is achieved. For example, a hardness of the impeller surface of greater than 1000 HV is preferred. The design of the impeller completely of carbide or ceramic may be effected, for example, with a sintering method, wherein the impeller blades are subsequently preferably ground, in order to form the end sides of the impeller blades as a defined axial bearing and sealing surface. If the opposite end side of the impeller is likewise to be designed as a sealing surface, this is preferably also ground, in order to create a defined bearing surface.

The pump assembly according to the invention, particularly preferably, comprises only one stage. The number of required individual parts is significantly reduced by the design as a single-stage pump assembly. Furthermore, the friction occurring in the whole pump assembly is decreased, whereby the efficiency may be increased. Furthermore, it is possible, as described above, to fix the impeller on the rotor shaft in the axial direction without any problem, which in turn permits the impeller to be able to be sealed in the axial direction at the suction port, and preferably the impeller at its end side opposite from the electric motor forms an axial bearing surface for the sliding mounting of the whole rotor in the axial direction. Again, a very good sealing of the impeller may be achieved by this axial abutting/bearing of the impeller, whereby the efficiency is increased. The friction, which is reduced as a whole, preferably permits the whole pump assembly to be operated at a high speed, for example greater than 20,000 rpm, whereby one may achieve a large delivery capability even with only one stage. Simultaneously, as previously described, the impeller is preferably also designed very small in its diameter, whereby the power loss is further reduced, and simultaneously the operation at a higher speed is favored. The diameter of the rotor, particularly preferably, also is designed in a very small manner. Thus, the friction losses in the motor are minimized, and the operation at a high speed favored. Particularly preferably, the rotor diameter is smaller than 25 mm, more preferably smaller than 20 mm. The smaller the rotor diameter, the lower is the occurring friction.

The electric motor, which is reduced in diameter, may be designed longer in the axial direction, in order to be able to provide an adequate power of the electrical motor with a small rotor diameter. Preferably, a very stiff rotor shaft is provided in order to permit this. A very stiff rotor shaft may be achieved by designing the rotor shaft, including the axial end at which the impeller is attached, as one piece, ideally as one piece with the complete rotor.

The pump assembly preferably comprises an electric motor with a permanent magnet rotor. This permits a simple construction of the motor. In order to further increase the efficiency of the motor, the diameter of the permanent magnet rotor is preferably selected as small as possible, in order to minimize the friction. A diameter smaller than 25 mm is particularly preferred. In order to simultaneously ensure a high magnetic capability, one may apply particularly strong permanent magnets, for example neodymium magnets.

As described above, the pump assembly according to the invention is preferably designed as a submersible pump assembly. It is particularly with submersible pump assemblies that a large delivery capacity is desired.

Further preferably, a counter-rotation disk facing the impeller is provided, which bears on an axial side of the impeller, preferably the axial side opposite from the electric motor, in a manner such that it forms an axial bearing surface. Thus, a sliding bearing is formed between the axial end side of the impeller or the impeller blades and the counter-rotation disk, the sliding bearing being able to serve as an axial bearing of the impeller and the whole rotor.

The counter-rotation disk preferably likewise comprises at least one surface of carbide or ceramic material, in order to be able to ensure the wear characteristics, which are required for a sliding bearing surface or sealing surface, even at highs speeds. It is also possible to design the counter-rotation disk completely of carbide or ceramic material. Particularly preferably, only the part of the counter-rotation disk facing the impeller is formed of such a material. The part facing away from the impeller may be designed of a different material or metal and, for example, may be bonded to the part facing the impeller. Here, one may also apply alternative methods or designs which ensure an adequate hardness or wear-resistance of the surface of the counter-rotation disk.

The axial side of the counter-rotation disk facing away from the impeller is preferably designed in a spherical manner, i.e., in particular in a hemispherical manner. This permits the counter-rotation disk to be able to be mounted in a corresponding spherical or hemispherical receiver, so that a self-centering or self-alignment of the counter-rotation disk parallel to the impeller or the axial end side of the impeller is achieved. This, one the one hand, simplifies the assembly and, on the other hand, ensures a wear-free and secure operation of the pump assembly, even at high speeds.

The impeller is preferably surrounded by a spiral housing or a guiding apparatus, whereby the delivered fluid, exiting radially out of the impeller, is deflected such that it may be led further, preferably in the axial direction, and be led out of the pump assembly into a connection conduit.

Particularly preferably, for this, the impeller is surrounded by a spiral housing, which extends in a helical manner and in a manner such that the exit opening of the spiral housing is aligned in the axial direction to the impeller, i.e., is aligned parallel to its rotation axis. This has the effect that the fluid, which exits from the impeller in the tangential/radial direction, is deflected by the spiral housing, with as little loss as possible, to an axially directed exit opening of the pump assembly.

Further preferably, the pump assembly comprises a wet-running electric motor with a can, which is manufactured of a non-metallic material, wherein the non-metallic material is provided with at least one additional, hermetically sealing layer. The can according to the invention thus consists preferably of a non-metallic material, i.e., of a material which influences the magnetic field between the rotor and stator as little as possible or not at all. A worsening of the efficiency on account of the arrangement of the can between the stator and rotor is avoided by the fact that the magnetic field remains uninfluenced by the can material. The hermetically sealing layer, which is preferably deposited on the outer or inner peripheral surface or on both peripheral surfaces, permits the use of a material for the can, which per se does not have a sufficient diffusion sealing ability. This means that one may select a material which primarily ensures an adequate stability of the can.

The diffusion sealing ability, of the type such that fluid located in the inside of the can, i.e., located in the rotor space, may not penetrate through the can into the stator space, is achieved by the additional layer, preferably deposited on the surface of the non-metallic material. One may also apply several layers of different materials in combination, in order to achieve the desired hermetic sealing between the inner space of the can and the outer peripheral region of the can. Thus, the wall of the can may be constructed in a multi-layered manner from the non-metallic material, and one or more layers of further materials, which ensure the diffusion sealing ability. For example, the diffusion-tight layer, which ensures the hermetic sealing, may be formed of a special plastic or paint. The diffusion-tight layer may furthermore be designed as a tube, film or film pot, in particular of metal. These may be deposited onto the non-metallic material, after the manufacture and forming/shaping of the material. Furthermore, it is possible to incorporate a film or a tube into the material already on forming/shaping the non-metallic material, so that the hermetically sealing layer covers the tube or the film at one or both sides or peripheral sides. Thus, the tube or the film may be arranged on the inside of the non-metallic material. This may be effected, for example, during the injection molding of the non-metallic material.

Further preferably, the at least one layer is designed as a coating on the inner and/or outer peripheral surface of the non-metallic material. Such a coating, after the manufacture or forming/shaping of the part of non-metallic material, may be deposited onto its surface, for example by spraying or vapour deposition.

The coating is preferably designed as a metal-coating of the non-metallic material. This means that a metal layer is deposited onto the inner and/or outer peripheral surface of the can, for example deposited by vapor. This metal layer then ensures a hermetic sealing. The coating of the non-metallic material, for example by metal-coating with a suitable material, is usefully effected such that the whole peripheral surface, which forms the separation between the rotor space in the inside of the can and the surrounding stator space, is accordingly coated, so that in this region, no fluid, for example water, may penetrate from the inside of the can through the can wall into the surrounding stator space. In this manner, it is possible to apply stators without a casting mass.

Particularly preferably, the can is manufactured of plastic and preferably of a fiber-reinforced plastic. The plastic permits an inexpensive manufacture of the can, for example by an injection molding method. Furthermore, plastic has no magnetic properties whatsoever, and does not therefore influence the magnetic field between the stator and the rotor. Furthermore, plastic is well suited for being coated or being provided with further surrounding and inner-lying plastic layers, in the manner of co-extrusion. A metal coating of the plastic is also possible without any problem. The fiber-reinforced construction may improve the stability or the pressure-strength of the can.

Preferably, the can is manufactured of a tubular component and a base element which closes the tubular component at a first axial end. This permits a simplified manufacture of the can, which for example also permits the manufacture of thin-walled plastic tubes by an injection molding method. On injection-molding the can, it may be useful for a core, forming the cavity in the inside of the can, to be held at both axial ends of the can, in order to achieve a very thin-walled design of the can. Thus, first the tubular component is manufactured and then the base element is later inserted into this tubular component, in order to close an axial opening of the tubular component and to form a can pot. The opposite axial end of the can is designed in an open manner, so that the rotor shaft may extend through this axial end to the pump space. The base element may be inserted into the tubular component with a non-positive fit, a positive fit and/or material fit, so that a firm, stable and preferably sealed connection is created between the tubular component and the base element.

The base element is preferably cast with the tubular component. Thereby, the base element, after manufacture of the tubular component, may be injected or cast onto the tubular component or cast into the tubular component in a second manufacturing step with the injection molding method, so that a permanent sealed connection is created between both elements.

The tubular component and the base element are further preferably both manufactured of a non-metallic material, preferably plastic, and after the assembly are together provided with the additional layer or coating. In this manner, the region of the base element and in particular the transition region between the tubular component and the base element are hermetically sealed by the coating. For example, the tubular component and the base element may be metal-coated together. Alternatively, the additional layer also may be brought onto the base element or integrated into this, in a separate manner.

According to a further preferred embodiment, a radially outwardly extending, preferably metallic collar is formed on one axial end of the can, preferably the end facing the pump space and the impeller of the pump, at the outer periphery. This metallic collar serves, for example, for the end side closure of the stator housing in which the stator winding is arranged. The stator housing is preferably hermetically encapsulated, in particular with the application of a submersible pump, so that no fluid may penetrate into the inside of the stator housing. Thus, the coils are protected in the inside of the stator housing, in particular from moisture. The metallic collar which is attached on the outer periphery of the can, serves for the connection to the outer parts of the stator housing, and permits the can to be welded with the remaining stator housing.

The collar is preferably connected to the non-metallic material with a positive fit and/or material fit, and together with this is provided with the additional layer or coating. Alternatively, a non-positive fit connection is also conceivable, as long as an adequate strength and sealing are ensured. The common coating of the non-metallic material of the can and of the collar has the advantage that, in particular, the transition region between the non-metallic material and the collar are also hermetically sealed by the coating. A particularly firm connection between the metallic collar and the non-metallic material of the can, so that movements between both elements, which could lead to a tearing of the coating, are avoided, is preferred, in order to ensure a permanent sealing in this region.

In order to achieve a particularly firm connection between the metallic material and the non-metallic material, the metallic collar is preferably connected to the non-metallic material directly on manufacture of the can. For example, the metallic collar may be inserted into the tool before injection molding and the plastic injected onto the collar, or a part of the collar may be peripherally injected with plastic, in the case of injection molding the can of plastic, so that a positive fit and material fit connection between both elements is achieved on injection molding.

In order to further improve the connection between the collar and the non-metallic material, a surface of the collar is structured or roughened, preferably before the connection to the non-metallic material. This may be effected, for example, by laser radiation, wherein small recesses or crater-like raised parts are incorporated into the surface of the collar by a laser beam, in which the non-metallic material, for example plastic, flows on casting, and thus creates a firm connection to the collar, on the one hand via a larger surface and on the other hand via a positive fit.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
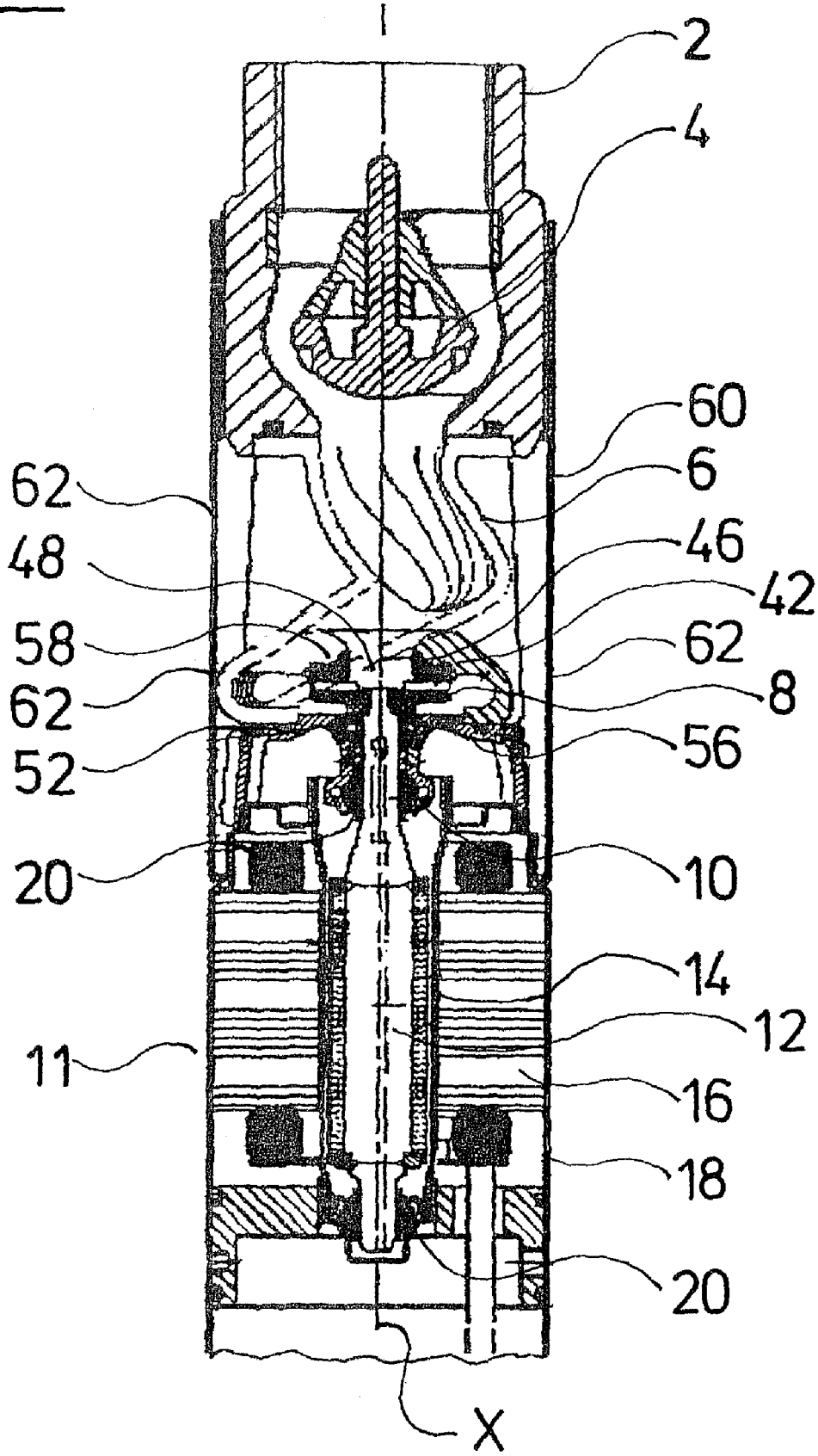
FIG. 1 is a longitudinal, sectional view of a pump assembly according to one embodiment of the invention.

FIG. 1 shows a sectional view of the upper end of a submersible pump. The lower end, in which the electronics for the control and regulation of the pump are attached, is not shown in the Figure. The pump assembly at its upper end comprises a connection stub 2 with a return valve 4 arranged therein. A spiral housing 6 which surrounds the impeller 8, connects upstream to the connection stub 2 in the inside of the pump assembly. The impeller 8 is arranged at the axial end of the single-piece rotor shaft 10 of the electric motor 11 or its permanent magnet rotor 12. The impeller 8 is firmly fixed on the rotor shaft 10, in particular is also firmly connected in the axial direction X. The permanent magnet rotor 12 runs inside of a can 14 which is annularly surrounded on its outer periphery by the stator 16. The stator 16 is designed in a known manner as a lamination bundle with coil windings. The stator 16 is hermetically encapsulated as a whole in a stator housing 18. The rotor shaft 10 is mounted in the radial direction in two radial bearings 20. These radial bearings 20 are preferably designed in a self-centering manner, so that a simple assembly and a secure operation is also ensured at high speeds.

Figure 2:
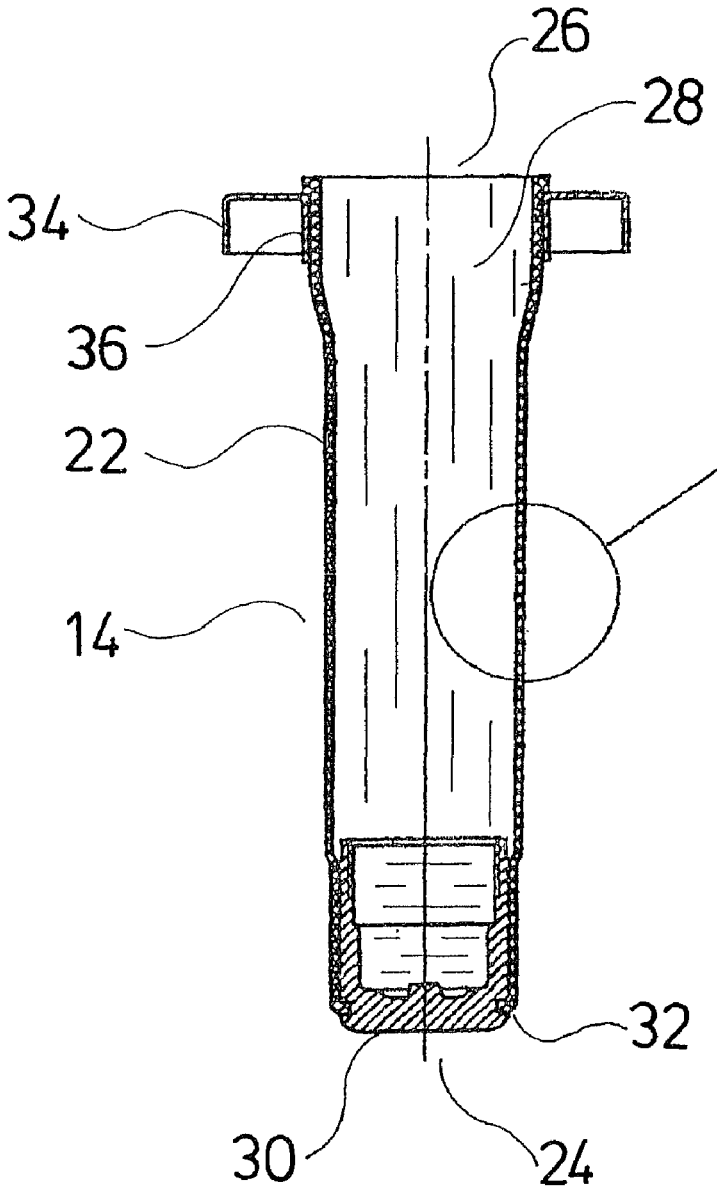
FIG. 2 is an enlarged, longitudinal, sectional view of the can of the electric motor of the pump assembly of FIG. 1.
Figure 3:
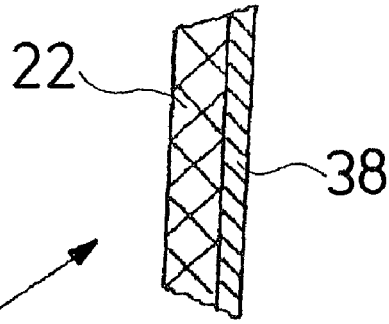
FIG. 3 is a cut-out enlargement of circled portion of FIG. 2.

The can 14, as shown in detail in FIGS. 2 and 3, is formed of plastic in the shown example. The can is formed of a tubular component 22, which is manufactured from a fiber-reinforced plastic by an injection molding method. The tubular component 22 is first formed with open axial ends 24 and 26, in order to be able to manufacture the tubular component in a particularly thin-walled manner with the required precision. This permits a core which forms the inner space 28 of the can 14, which later forms the rotor space, to be able to be fixed at both axial ends in the tool. After the injection molding of the tubular component 22, this is then closed at the axial end 24 by a base element 30, so that a can pot is formed. The base element 30 may preferably likewise be formed of plastic and may be cast into the previously injected tubular component 2. Alternatively, the base element 30 may be manufactured in a separate manner and later may be inserted into the tubular component 22. As shown, a positive-fit connection is created between the base element 30 and the tubular component 22, in that the inwardly bent, axial peripheral edge of the tubular component 22 engages into a peripheral groove 32 of the base element 30.

A collar 34 is applied on the outer periphery of the tubular component 22, at the opposite axial end 26 which faces the impeller 8. The collar 34 is formed of metal, preferably rust-free stainless steel, and is annular, wherein its inner diameter is matched to the outer diameter of the tubular component 22 at the axial end 26. The ring of the collar 34 comprises a U-shaped cross section, wherein the transverse limb faces the axial end 26. The inner wall 36 of the collar 34 lies parallel on the peripheral wall of the tubular component 22, and is connected to this.

The connection between the inner wall 36 of the collar 34 and the tubular component 22 is already effected during the manufacturing process, i.e., the molding process of the tubular component 22, in that the collar 34 is previously applied into the tool, so that the tubular component 22 is molded directly onto the inner wall 36 of the collar 34. Thus, a firm positive fit and/or material fit connection between the plastic of the tubular component 22 and the inner wall 36 of the collar 34 is created. In order to improve this connection, the inner wall 36 at its outer periphery is previously roughened or structured. This may preferably be effected by laser machining, whereby small recesses are incorporated into the metal or the sheet metal of the collar 34 on the surface, into which recesses the plastic of the tubular component 22 then flows on injection molding. These recesses may, particularly preferably, also comprise undercuts, whereby an even firmer connection is created between both elements.

The can 14 created in such a manner is metal-coated after injection molding the tubular component 22, with which the collar 34 is connected directly to the tubular component 22, and after the subsequent insertion of the base element 30. Thereby, a thin metal layer 38 is deposited on the outer surface of the can 14, as shown in FIG. 3. The metal layer 38 coats the whole outer periphery of the tubular component 22 and the base element 30, as well as the collar 34. In this way, in particular also the transition regions between the collar 34 and the tubular component 22, as well as between the base element 30 and the tubular component 22, are covered by the metal layer 38. The metal layer 38 ensures that a hermetic sealing of the can 14 and in particular of the peripheral wall of the tubular component 22 is created. This hermetic sealing by the metal layer 38 has the effect that fluid which is located in the rotor space 28, may not penetrate through the can 14 into the inside of the stator housing 18, in which the stator 16 is arranged. The metallization or coating 38 thereby permits the use of a plastic for the tubular component 22 and the base element 30, which per se is not diffusion-tight. Thus here, the plastic may be selected purely according to the requirements of stability for the can 14, as well as according to manufacturing aspects.

A can 14 has been described previously, which is provided with the metal layer 38 on its outer side. Alternatively, it is also possible to provide the can 14 with a metal layer by metal coating, on its outer side as well as on the inner surfaces of the inner space 28. Furthermore, it is alternatively possible to only metal coat the can on the inner walls of the inner space 28.

Figure 4:
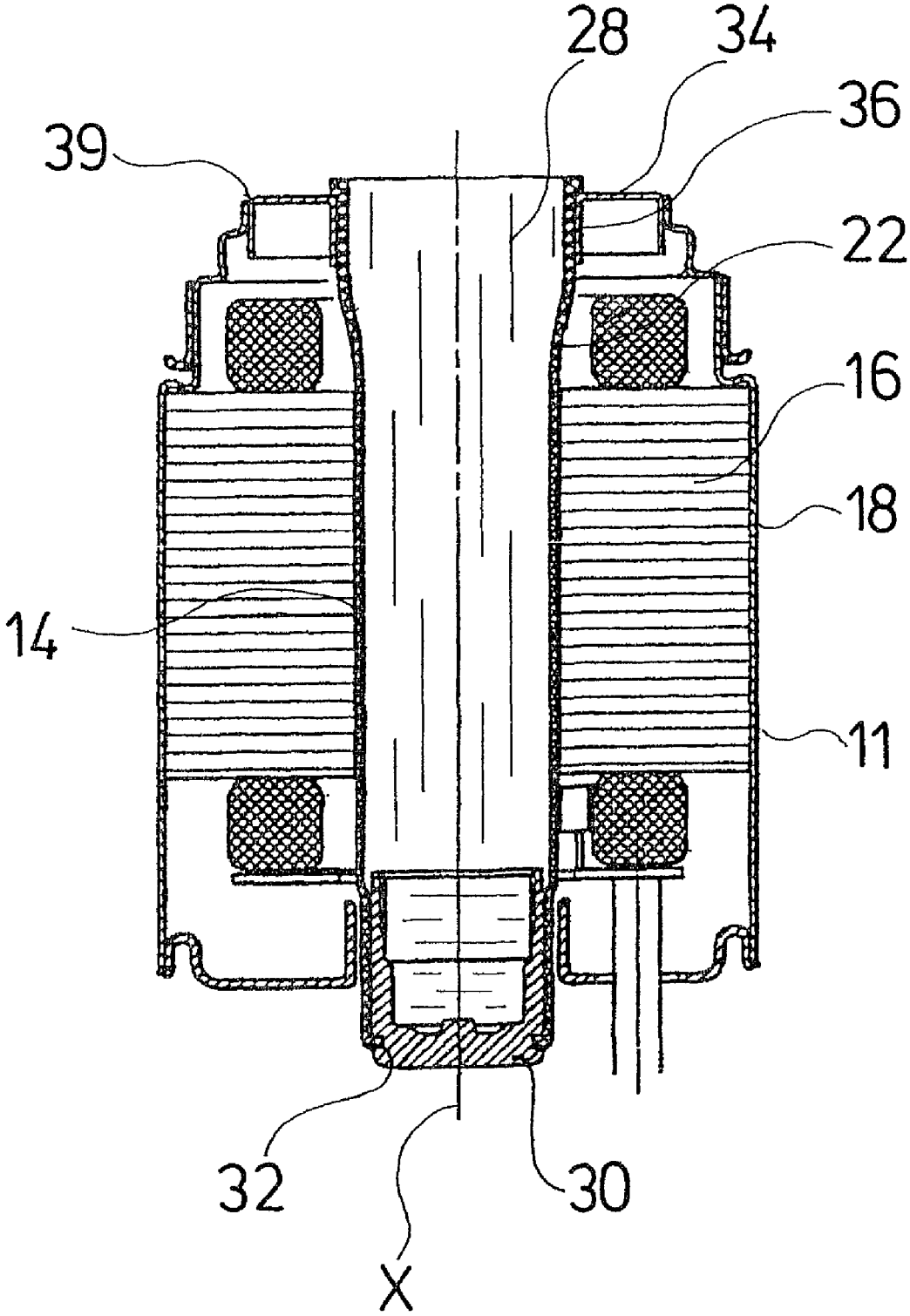
FIG. 4 is an enlarged, longitudinal sectional view of the electric motor of FIG. 1.

The metallic collar 34 serves for connecting the can 14 to the remaining part of the stator housing 18. This may, in particular, be effected by a welding seam 39 on the outer periphery of the metallic collar 34. The collar 34 thus creates the connection to other metallic components from which the stator housing 18 is formed, as shown in FIG. 4.

The use of the can 14 of plastic, i.e., of a non-metallic material without magnetic properties, has the advantage that the can 14 influences the magnetic field between the stator 16 and the permanent magnet rotor 12 only a little or not at all, by which the efficiency of the electric motor 11 is increased.

With the pump assembly according to the invention, the diameter of the permanent magnet rotor 12 and of the impeller 8 is kept small, in order to minimize the friction in the system and thus the power loss as much as possible. Nevertheless, in order to ensure a high efficiency of the electric motor 11, the permanent magnet rotor 12 is equipped with particularly strong permanent magnets, for example neodymium magnets. In the shown example, the rotor diameter is 19 mm. The shown electric motor 11 is designed for very high rotational speeds >20,000 rpm, in particular between 25,000 and 30,000 rpm. Thus, one may achieve a sufficient delivery capacity with only one impeller 8 with a relatively small diameter.

Figure 5:
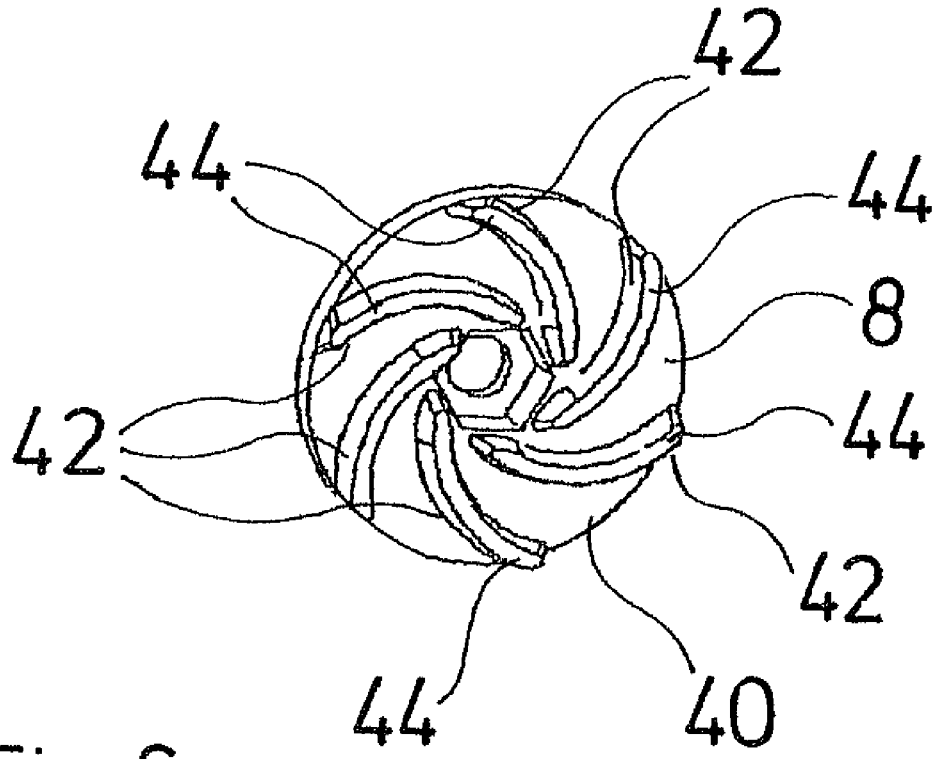
FIG. 5 is an end perspective view of the impeller showing the impeller blades.
Figure 6:
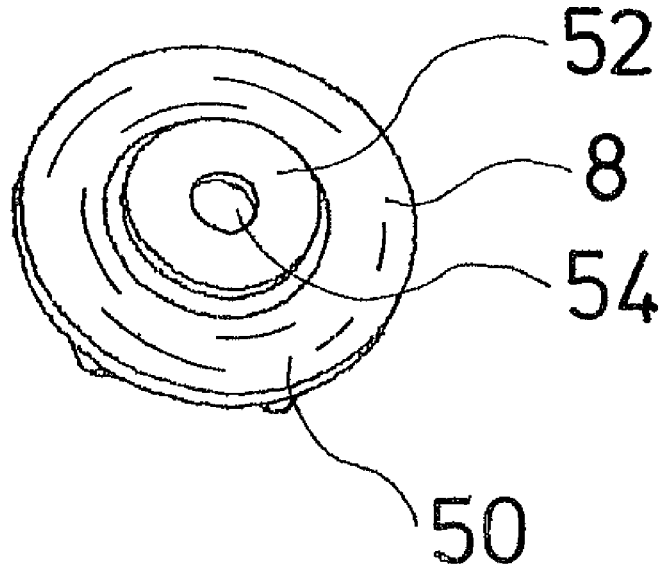
FIG. 6 is an end perspective view of the impeller of the side opposite to the impeller blades.

The impeller 8, which is shown as an individual part in FIGS. 5 and 6, is manufactured of carbide in order to guarantee a high wear-resistance. The impeller blades 42 are formed on an axial side 40 which is furthest from the electric motor 11 in the installed condition. The impeller 8 is designed in an open manner, i.e., the impeller blades project from the axial side 40 of the impeller 8, and are not closed by a cover disk at their end sides 44.

The end sides or end edges 44 of the impeller blades 42 are ground, and thus form an axial bearing and sealing surface of the impeller 8. The end sides 44 in the assembled condition bear on a counter-rotation disk 46, which annularly surrounds the suction port 48 of the pump. The complete rotor 12 is supported via the impeller 8 in the axial direction on the counter-rotation disk 46, on account of the firm connection of the impeller 8 to the rotor shaft 10. That is, the end face of the counter-rotation disk 46, which faces the impeller 8, and the end sides 44 of the impeller blades 42 form an axial sliding bearing. The end sides 44 of the impeller blades 42 are pressed against the counter-rotation disk 46 by the axial pressing force of the impeller 8, such that a particularly good sealing between the impeller blades 42 and the counter-rotation disk 46 occurs. Losses in the pump are minimized by this, and the performance of the pump assembly is increased further, indeed at the higher motor speed described above. In this manner, one may achieve a high pump performance with the described very small impeller, even with a single-stage design of the pump assembly. The impeller 8 thereby assumes the axial-side sealing with respect to the counter-rotation disk 46 at the suction port 48, and simultaneously the axial bearing function, so that here too, the number of components and the occurring friction are minimized.

The rear side 50 of the impeller 8 opposite from the impeller blades 42 comprises a further annular sealing surface 52, which annularly surrounds the opening 54 for receiving the rotor shaft. The sealing surface 52 bears on a seal 56, which surrounds the rotor shaft 10 in a stationary manner, and seals the rotor space 28 in the inside of the can 14, towards the pump space, in which the impeller 8 is arranged. This seal 56 is held in its bearing on the sealing surface 52 by a spring effect. The seal 56 ensures that contamination in the fluid, which is delivered by the impeller 8, may penetrate into the rotor space 28 in the inside of the can 14, and there lead to undesired friction or contamination.

The counter-rotation disk 46 is preferably likewise designed of hard metal or of ceramic. The side 58 furthest from the impeller 8 is designed in a spherical manner (not shown in FIG. 1) and is mounted in a spherical receiver in the pump housing, so that the counter-rotation disk 46 may automatically align itself parallel to the impeller 8. This part of the counter-rotation disk, which forms the rear side 58, may be designed of a material different from carbide or ceramic, and may be connected to the part of the counter-rotation disk 46 which faces the impeller 8, for example by bonding.

The impeller 8 is peripherally surrounded by a spiral housing 6. The spiral housing 6, proceeding from the peripheral region of the impeller 8, extends in a helical manner to the connection stub 2, so that a flow deflection in the axial direction is effected. That is, the flow which exits in the radial/tangential direction at the outer periphery of the impeller 8, is first deflected by the spiral housing 6 in a purely tangential direction or peripheral direction of the impeller 8, and then steered with as little loss as possible in the axial direction on account of the helical winding of the spiral housing 6, so that the flow may exit out of the pump assembly at the connection stub 2 in the axial direction. The spiral housing 6 is preferably likewise manufactured as an injection molded part of plastic. The spiral housing 6 moreover contains the likewise spherical receiver for the counter-rotation disk 6 at its lower end facing the impeller 8, and centrally forms the suction port 48 of the pump, through which the fluid is suctioned by rotation of the impeller 8. The outer housing of the pump assembly, in the region in which the spiral housing 6 is arranged in its inside, comprises an entry opening 62 in its outer peripheral wall, through which the fluid enters from the outside, flows around the spiral housing 6 from the outside, and then enters the suction port 48.

With all the previously described elements, i.e., with a can 14 of plastic with metal-coating, with a small pressure sensor of the rotor 12, with an impeller 8 with a small diameter of carbide, which simultaneously assumes the sealing and axial mounting, one may create a very capable compact submersible pump assembly, which achieves a large pump performance with only one stage with a high operational speed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A pump assembly having a wet-running electric motor, comprising an impeller (8) of the pump assembly being driven by the electric motor (11) at a maximal speed of greater than 20,000 rpm, wherein the impeller (8) is axially sealed in a region of a suction port (48) of the pump assembly, and wherein the electric motor runs with fluid in a rotor space thereof throughout an entire operation of the electric motor.

2. The pump assembly according to claim 1, wherein at least one axial end side (44) of the impeller (8) forms an axial bearing surface, which simultaneously serves as an axial sealing surface.

3. The pump assembly according to claim 2, wherein the impeller (8) has an axial side (40) at which impeller blades (42) are arranged, the axial side being designed in an open manner, and the at least one axial end side (44) is on the impeller blades to form the axial bearing surface of the impeller (8).

4. The pump assembly according to claim 1, wherein the impeller (8) is fixed on a rotor shaft (10) in an axial direction (X).

5. The pump assembly according to claim 1, wherein an axial side (50) of the impeller (8), which faces the electric motor (11), is formed as a sealing surface (52) for sealing a rotor space (28) of the electric motor (11).

6. The pump assembly according to claim 1, wherein the impeller (8) comprises at least one surface of carbide or ceramic.

7. The pump assembly according to claim 1, having only one stage.

8. The pump assembly according to claim 1, wherein the electric motor (11) is a permanent magnet motor (12).

9. The pump assembly according to claim 1, which is a submersible pump assembly.

10. The pump assembly according to claim 1, further comprising a counter-rotation disk (46) facing the impeller (8), the counter-rotation disk bearing on an axial side (44) of the impeller in a manner such that it forms an axial bearing surface.

11. The pump assembly according to claim 10, wherein the counter-rotation disk (46) comprises at least one surface of carbide or ceramic material.

12. The pump assembly according to claim 10, wherein an axial side (58) of the counter-rotation disk (46) facing away from the impeller (8) has a spherical shape.

13. The pump assembly according to claim 1, wherein the impeller (8) is surrounded by a spiral housing (6).

14. The pump assembly according to claim 13, wherein the impeller (8) is surrounded by a spiral housing (6), which extends in a helical manner and in a manner such that an exit opening of the spiral housing (6) is aligned in an axial direction (X) to the impeller (8).

15. The pump assembly according to claim 1, wherein the wet-running electric motor (11) has a can (14) comprising a non-metallic material, wherein the non-metallic material has at least one additional, hermetically sealing layer (38).

16. The pump assembly according to claim 15, wherein the at least one additional layer (38) comprises a coating on an inner and/or outer peripheral surface of the non-metallic material.

17. The pump assembly according to claim 16, wherein the coating comprises a metal coating of the non-metallic material.

18. The pump assembly according to claim 15, wherein the can (14) comprises a fiber-reinforced plastic.

19. The pump assembly according to claim 15, wherein the can comprises a tubular component (22) and a base element (30), which closes the tubular component (22) at a first axial end (24) of the tubular component.

20. The pump assembly according to claim 19, wherein the tubular component (22) and the base element (30) comprise a non-metallic material, and together are provided with the additional layer (38) after being put together.

21. The pump assembly according to claim 15, further comprising a radially outwardly extending collar (34) at an axial end (26) of the can (14) on an outer periphery of the can.

22. The pump assembly according to claim 21, wherein the collar (34) is connected to the non-metallic material with a positive fit and/or material fit, and together with the non-metallic material is provided with the additional layer (38).

23. The pump assembly according to claim 21, wherein a surface (36) of the collar (34) is structured before connection to the non-metallic material of the can (14).

24. A pump assembly comprising:

a wet-running electric motor having a can with an inner space containing fluid, a rotor capable of running inside the can, a stator directly engaging an entire outer periphery of the can, a stator housing directly engaging an entire outer periphery of the stator; and an impeller driven by the wet-running electric motor at a maximal speed of greater than 20,000 rpm, the impeller being axially sealed in a region of a suction port of the pump assembly.

* * * * *